US011077332B2

(12) United States Patent
Fennell

(10) Patent No.: US 11,077,332 B2
(45) Date of Patent: Aug. 3, 2021

(54) FITNESS WEIGHT SUPPORT

(71) Applicant: David Louis Fennell, Montreal (CA)

(72) Inventor: David Louis Fennell, Montreal (CA)

( * ) Notice: Subject to any disclaimer, the term of this patent is extended or adjusted under 35 U.S.C. 154(b) by 70 days.

(21) Appl. No.: 16/580,010

(22) Filed: Sep. 24, 2019

(65) Prior Publication Data

US 2021/0086016 A1 Mar. 25, 2021

(51) Int. Cl.
*A63B 21/078* (2006.01)
*A63B 21/072* (2006.01)

(52) U.S. Cl.
CPC ..... *A63B 21/078* (2013.01); *A63B 21/0726* (2013.01); *A63B 21/0724* (2013.01); *A63B 2208/0252* (2013.01); *A63B 2225/093* (2013.01)

(58) Field of Classification Search
CPC ..... A63B 21/078; A63B 21/4029; A63B 71/0036; A63B 21/0726; A63B 21/0724; A63B 2208/0252; A63B 2225/093; A63B 1/00; A63B 1/005; A63B 1/04; A63B 21/0004; A63B 21/00043; A63B 21/065
See application file for complete search history.

(56) References Cited

U.S. PATENT DOCUMENTS

| | | | | |
|---|---|---|---|---|
| 9,492,701 | B1 * | 11/2016 | Bognatz | A63B 21/072 |
| 9,717,943 | B2 * | 8/2017 | Klonoski | A63B 71/0036 |
| D850,814 | S | 6/2019 | York et al. | |
| 2007/0049472 | A1 * | 3/2007 | Hummer, Jr. | A63B 71/0036 482/104 |
| 2015/0141214 | A1 * | 5/2015 | Morway | A63B 21/0724 482/107 |

OTHER PUBLICATIONS

"Dumbbell Spotting Stand for SB/PRO"; Ironmaster; https://www.ironmaster.com/products/dumbbell-spotting-stand/, 2019.
"Dumbbell Weight Bar Holders for T-3 Power Rack" Titan Manufacturing and Distributing Inc., http://www.titan.fitness/racks/rack-accessories/t-3-series/dubmbell-weight-bar-holders-for-t-3-power-rack/400236.html; 2020.
"EliteFTS Dumbbell Spotter Stands", VBMFITNESS LLC, undated.
"Gorilla Sports Dumbbell Power Hooks—100711-00046-0001"; Gorilla Sports; 2020.
"Smart Spotter for Dumbbells" RWJ Extreme Fitness, LLC; 2020.

* cited by examiner

*Primary Examiner* — Nyca T Nguyen
*Assistant Examiner* — Andrew M Kobylarz
(74) *Attorney, Agent, or Firm* — Wissing Miller LLP

(57) ABSTRACT

There is disclosed a fitness weight support that can be removably connected with weightlifting rack to allow a lifter to position free weights such as dumbbells before, between, and after sets of a weight-lifting exercise. The support includes one or more platforms adapted to support the weights. The platform is connected with a support member. Two engaging bars are connected with the support member and extend outward from the platform. The bars are adapted to removably engage with support fixtures, such as j-hooks, connected with the rack. A rotation stop extends from at least one of the engaging bars. When the engaging bars are engaged with the j-hooks, the rotation stop contacts a vertical stanchion of the rack to prevent rotation of the bar and to hold the platform substantially horizontal. By adjusting the j-hooks to a selected height on the rack, dumbbells can be supported on the platform at the proper height for the lifter to perform the exercise and for the lifter to rest the dumbbells between sets.

19 Claims, 9 Drawing Sheets

FITNESS WEIGHT SUPPORT

BACKGROUND

Field

The present disclosure relates to a support for holding weights, such as dumbbells, at a selected position between sets of a weight-lifting exercise. More particularly, the present disclosure provides a fitness weight support that can be removably connected with a wide variety of commercially available weight-lifting racks that holds dumbbells above a weightlifter's body to facilitate exercises performed using dumbbells.

Description of the Related Art

Weight training exercises, such as a bench press using a barbell, are often performed using a rack that supports the barbell before a set of repetitions and between sets. Weight-lifting racks include hooks or other fixtures on which the barbell can rest while the user positions himself or herself to get ready for a lift. The hooks also provide a place for the user to rest the weight once the user has finished a set of lifting repetitions.

One such support is called a power rack. Power racks are commonly used to support an Olympic bar with weights positioned on the ends of the bar. The power rack includes a sturdy frame with an open space for the lifter to stand or squat, or where the lifter can position a weight-lifting bench. Vertical stanchions are located on either side of the open space. The stanchions may include a number of holes or other attachment areas arranged at a range of vertical heights where hooks for supporting the barbell can be attached. The weightlifter configures the hooks on the stanchions at the proper height to hold the bar for the particular exercise he or she will perform. Once the hooks are set at the proper height, the lifter positions the Olympic bar on the hooks and adds a selected number of plates to each end of the bar. The bar spans the distance between the stanchions with the ends of the bar outside of the open space. The weightlifter positions him or herself inside the open space of the rack and grasps the bar with both hands at locations that balance the weight. The lifter begins the exercise by raising the bar above the height of the hooks to disengage the bar from the hooks. The lifter performs a number of repetitions of the exercise and then lifts the bar above the hooks and rests the bar on the hooks.

Providing hooks to rest the Olympic bar at a variety of selected heights make a wide variety of exercises possible. The bar can be positioned at a distance above the lifter's body so that the lift is performed within a specific range of motion, allowing the lifter to target particular muscle groups. Providing adjustable-height hooks also makes exercises safer. In many instances, the lifter performs a number of repetitions and/or lifts a selected amount of weight so that his or her muscles are near to "failure," that is, the lifter reaches a point where he or she cannot perform one more repetition. At this point, the lifter must rest the weight or risk having the weight drop onto them. The lifter may have another person act as a "spotter" to help the lifter finish a set by helping to raise the bar on the final repetition, but the spotter and the lifter must have a safe place to rest the weight when the set is done.

Weightlifters may also use dumbbells and other kinds of "free weights." For many free-weight exercises the lifter grasps one dumbbell in each hand, as opposed to an Olympic bar where the weight is lifted using both hands. Controlling the weight of the dumbbell with one hand activates muscles that are not used when the lifter uses an Olympic bar, or other weightlifting equipment that fixes the positions of the lifter's hands with respect to one another. Weightlifters often perform combinations of exercises using barbells and free weights, such as dumbbells.

Support equipment, such as a power rack, generally cannot be used to support dumbbells during an exercise. The dumbbell is not long enough to span the distance between hooks positioned on the stanchions of the rack. Thus, to perform a dumbbell exercise, the lifter must raise the weight to the starting position of an exercise him or herself or with the assistance of a spotter. Once a set of the exercise is completed, the lifter must lower the weight to a stable location, for example, to the floor or else let the weights fall to the floor. Dropping weights may be dangerous in a crowded gymnasium. In addition, because the dumbbells must be lifted to the starting position of an exercise, the amount of weight that can be used for an exercise may be limited to the lifter's ability to get the weight to the starting position.

Thus, there is a need for an improved fitness weight support that can safely support dumbbells at a selected position so that the dumbbells can be grasped by a weight-lifter at the start of a set of repetitions of an exercise and that can safely receive and support the dumbbells once the lifter has completed the set of repetitions. There is also a need for such a support that can be conveniently connected with commonly used equipment to minimize the cost and complexity of providing such a functionality.

SUMMARY

The present disclosure relates to apparatuses and methods to address these and other difficulties.

According to one embodiment, there is disclosed a removeable fitness weight support for a weightlifting rack comprising a platform adapted to support a fitness weight, two engaging bars, the bars extending outward from the platform, wherein the bars are adapted to removably engage with corresponding support fixtures of the rack, a support member connected with the platform and extending between the engaging bars, wherein the platform is supported by the support member, and a rotation stop extending from at least one of the engaging bars, wherein when the bar is engaged with the corresponding support fixture, the rotation stop contacts a vertical stanchion of the rack to prevent rotation of the bar and to hold the platform substantially horizontal.

According to one aspect the platform comprises a bottom panel and one or more guiding wedges, wherein, when a fitness weight is lowered onto the platform, the guiding wedges guide the weight onto the bottom panel. When the engaging bars are engaged with the corresponding support fixtures and the rotation stop is in contact with the stanchion of the rack, the bottom panel is horizontal and the guiding wedge is at an oblique angle with respect to the bottom panel. According to another aspect, the rotation stop comprises, an arm connected to one of the engaging bars and extending perpendicular to a longitudinal axis of the bar, and a jam pin extending from the arm parallel with the longitudinal axis a selected distance along the arm from the bar, wherein, when the bar is engaged with the support fixture, the jam pin contacts the stanchion of the rack to prevent rotation of the bar. The arm may comprise an engagement portion, wherein the engagement portion removably connects the arm with the engaging bar. The engaging bar may comprise a polygonal shaped portion and the engagement portion may comprise a polygonal hole, the polygonal hole adapted to fit onto the polygonal portion.

According to another aspect, the support further comprises two offsets, the offsets connecting the engaging bars with the support member, wherein a center of mass of the platform is offset from the longitudinal axis, wherein the offset center of mass tends to rotate the support in a first direction and wherein the stanchion of the rack engages the jam pin in a direction opposite the first direction.

The platform may comprise two fitness weight receiving portions, each receiving portion adapted to stably support a fitness weight. The arm may comprise a plurality of jam pin receiving portions and wherein the jam pin is removably engaged with a selected one of the receiving portions, the selected receiving portion being selected to adjust an angle of the platform when the bars are engaged with the support fixtures and the jam pin is engaged with the stanchion of the rack.

According to another embodiment, there is disclosed a fitness weight support comprising a fitness weight supporting platform, two engaging portions connected with and supporting the platform, wherein the engaging portions extend outward from opposite sides of the platform and are aligned along a longitudinal axis, and a rotation stop fixed to at least one of the engaging portions and adapted to hold the platform in a horizontal orientation to receive one or more fitness weights. The platform may comprise two fitness weight receiving portions, each adapted to hold a respective fitness weight.

According to one aspect, the support further comprises two offset arms connected with respective ones of the engaging portions and extending perpendicular to the axis, and a platform supporting bar extending parallel with the axis and connecting the offset arms to one another, wherein the offset arms and support bar support the weight receiving portions an offset distance from the axis.

According to another aspect the rotation stop comprises an arm extending perpendicular to the axis and a jam pin connected with the arm and extending parallel to the axis in the inboard direction, wherein the jam pin is adapted to engage with a vertical stanchion of a rack to prevent the engaging portion from rotating in at least one direction.

The fitness weight supporting platform may comprise a sloped front panel, a sloped rear panel, and a horizontal support surface, wherein the fitness weight is received along upper surfaces of the front and rear panels and rests on the support surface. The fitness weight supporting platform may further comprise an inboard receiver and an outboard receiver, wherein the inboard and outboard receivers are separated by a distance sufficient for a user to extend a hand between the receivers and grasp a handle of the fitness weight disposed on the inboard and outboard receivers. The inboard receiver may comprise a sloped inboard front panel and a sloped inboard rear panel, the outboard receiver may comprise a sloped outboard front panel offset a first distance from the sloped inboard front panel and a sloped outboard rear panel offset a second distance from the sloped inboard rear panel, and the first and second distances may be selected to orient a fitness weight supported by the platform a first angle with respect to the longitudinal axis. The first angle may be between about 20 degrees and about 60 degrees, preferably about 40 degrees. The inboard receiver may comprise a horizon inboard horizontal support surface and an inboard rail, the inboard rail extending along an outboard edge of the inboard receiver and vertically from the inboard support surface, wherein a first end of the fitness weight resting on the inboard support surface is prevented from moving in the outboard direction by the inboard rail. The outboard receiver may comprise an outboard horizontal support surface and an outboard rail, the outboard rail extending along an inboard edge of the outboard receiver and vertically from the outboard support surface, wherein a second end of the fitness weight resting on the outboard support surface is prevented from moving in the inboard direction by the outboard rail.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
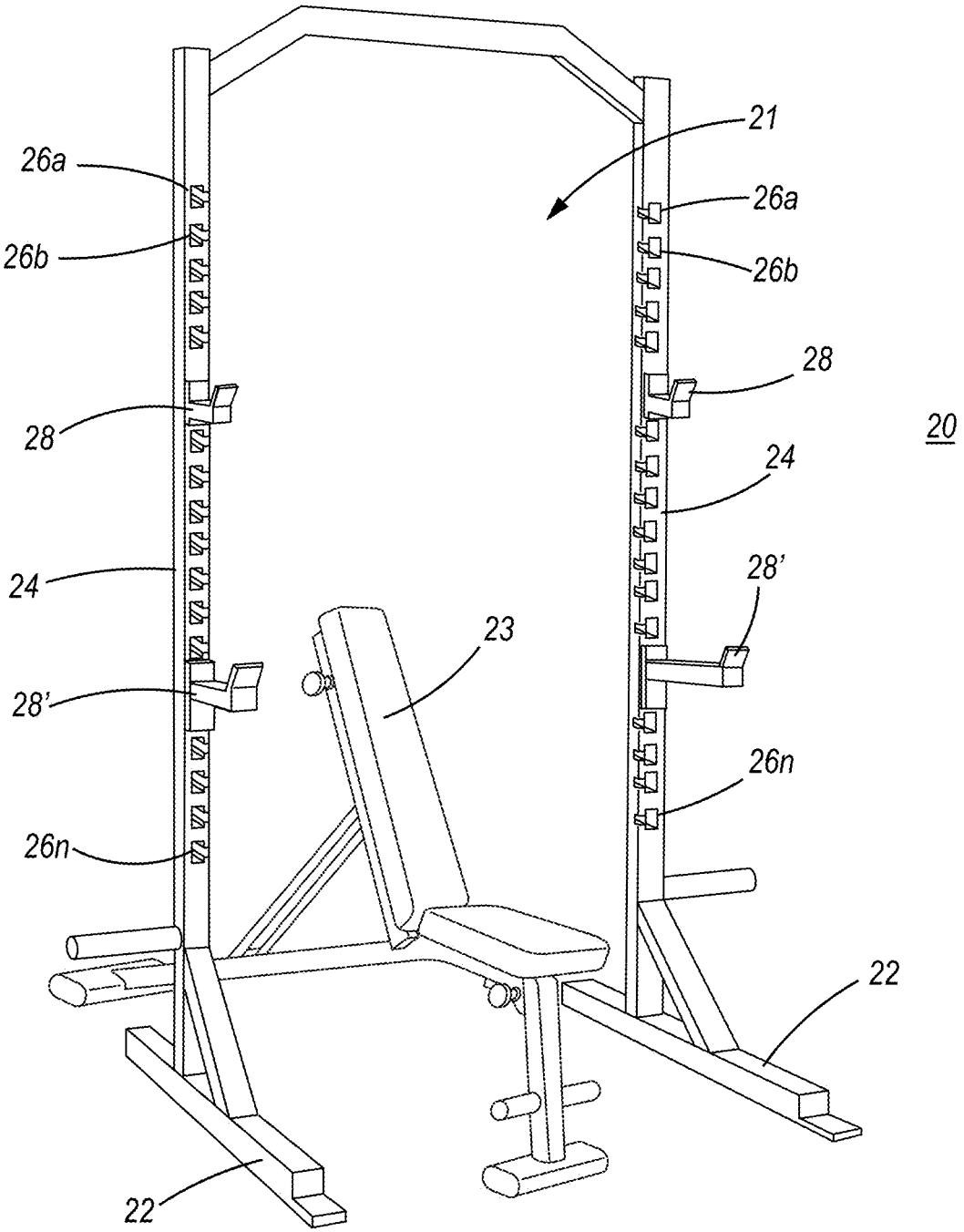
Fig. 1 PRIOR ART
FIG. 1 is a perspective view of a typical weightlifting rack and bench.

FIG. 1 illustrates one type a known rack 20 for supporting fitness training weights, called a half rack. The rack consists of legs 22 that form a stable base. Extending upward from the base are a pair of vertical stanchions 24. An open space 21 is provided between the stanchions. A bench 23 may be positioned within space 21 to support a weightlifter's body when performing certain exercises. Alternatively, the bench may be removed for exercises where the lifter is standing or squatting.

Located along the faces of stanchions are a plurality of connection points 26*a*, 26*b*, . . . 26*n*. Respective ones of the connection points on each stanchion are located at the same height above legs 22. J-hooks 28 connect with the stanchions 24 and engage with connection points 26*a*, 26*b*, . . . 26*n*. Instead of, or in addition to j-hooks 28, the rack may be equipped with bar rests 28' or other fixtures that support an Olympic bar. Bar rests 28' may also engage with connection points 26*a*, 26*b*, . . . 26*n*. J-hooks 28 and bar rests 28' can be engaged with selected ones of connection points 26*a*, 26*b*, . . . 26*n* to provide a place to support an Olympic bar at a selected height. As discussed above, known racks, such as the one shown in FIG. 1 are typically not suitable for supporting dumbbells.

The connection points 26*a*, 26*b*, . . . 26*n* for commercially available power racks often have proprietary configuration to engage with j-hooks 28 or other weight supporting attachments made by that same manufacturer. Thus, a rack made by one manufacturer cannot typically be used with j-hooks made by another manufacturer. The j-hooks themselves, however, are designed to engage with, and support, barbell bars within a typical range of diameters, usually from about 25 millimeters (0.98 in) to about 50 millimeters (1.96 in), regardless of the rack manufacturer.

As used herein, "outboard" refers to a position or a direction away from the center of opening 21 where a weightlifter is positioned during an exercise. The term "inboard" refers to a position or direction toward the center of opening 21.

Figure 2A:
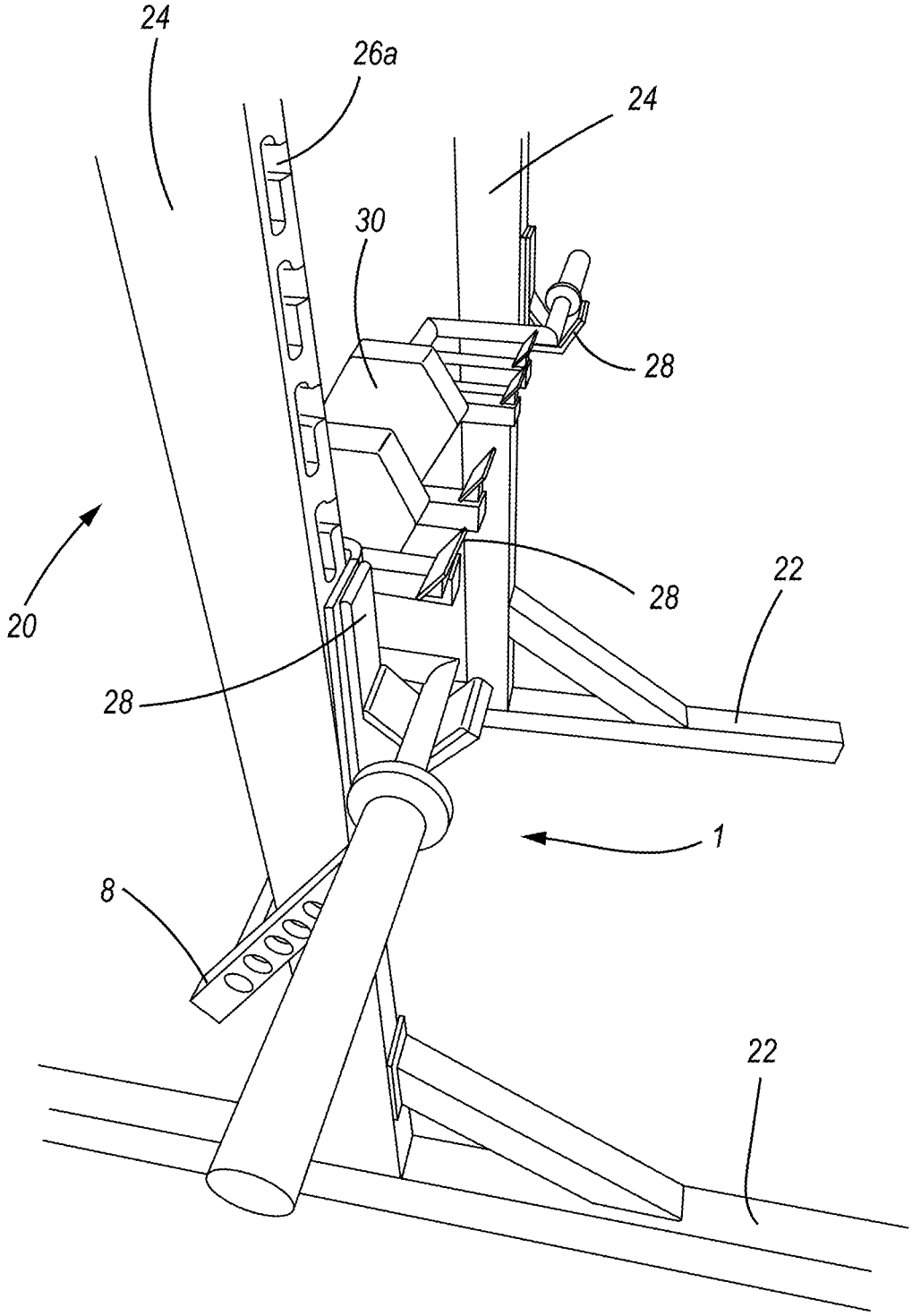
FIG. 2*a* is a perspective view of a fitness weight support according to an embodiment of the disclosure installed on the rack of FIG. 1.
Figure 2B:
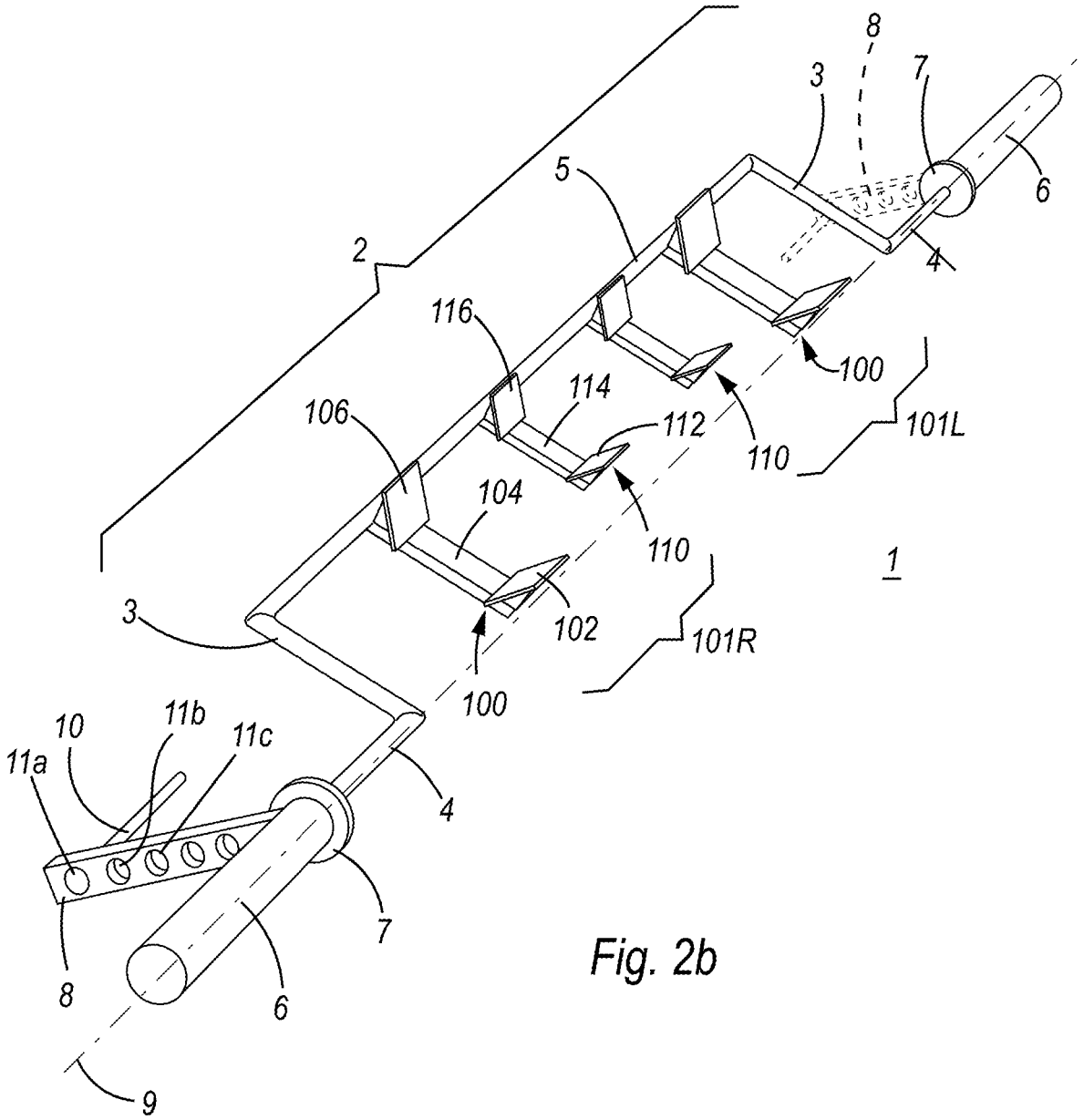
FIG. 2*b* is a perspective view of the fitness weight support according to the embodiment of FIG. 2*a;*

FIG. 2*a* shows a power rack 20, such as the one in FIG. 1, equipped with a removable weight support 1 according to an embodiment of the disclosure. Support 1 rests on j-hooks 28. J-hooks 28 are position at selected connection points 26*a*, 26*b*, . . . 26*n* of the rack at an equal height along stanchions 24 so that support 1 extends horizontally. Dumbbell 30 is shown positioned on right side of support 1. A second dumbbell (not shown) may be positioned on the left side of support 1. FIG. 2*b* shows a perspective of the embodiment of support 1 shown in FIG. 2*a* separate from the rack and without the dumbbells.

As shown in FIG. 2*b*, support 1 is formed by frame 2 that extends between end pieces 6. Frame 2 consists of hook engaging portions 4 connected with offset sections 3. Weight support bar 5 extends between offset sections 3. End pieces 6 and hook engaging portions 4 are located along the longitudinal axis 9 of support 1. Offsets 3 are perpendicular to axis 9 and bar 5 is parallel to the axis.

Extending from weight supporting bar 5 are left and right dumbbell supports 101L and 101R. Stop rings 7 are positioned between the end pieces 6 and the hook engaging portions 4. Extending from one of the end pieces 6 is arm 8. Arm may be located at the right side of support 1, as shown by solid lines or the left side, as shown by broken lines. Arm 8 has a number of engagement holes 11*a*, 11*b*, 11*c*. Jam pin 10 is fitted into a selected one of holes 11*a*, 11*b*, 11*c*, as will be explained below.

Left and right dumbbell supports 101L, 101R are each formed by outboard receiver 100 and inboard receiver 110. Inboard and outboard receivers 100, 110 are connected with bar 5. Outboard receivers 100 are located further from the middle of the support 1 and closer to offsets 3 and support the end of a dumbbell 30 positioned outward of the weightlifter's body. Inboard receivers 110 are located closer to the center of the supports and support the end of the dumbbell inward of the weightlifter's body. Right dumbbell support 101R is formed by one pair of outboard 100 and inboard 110 receivers. Left dumbbell support 101L is likewise formed by a pair of outboard 100 and inboard 110 receivers.

Inboard and outboard receivers have weight supporting platform surfaces, 114 and 104, respectively. When support 1 is installed on rack 20, as shown in FIG. 2*a*, platforms 114 and 104 are held horizontal and provide surfaces that support ends of dumbbells 30. Outboard receivers 100 include centering wedges 102 and 106 at either end of platform 104. Centering wedges 102, 106 help to guide the motion of outward facing end of the dumbbell 30 onto the platform 104 when the weightlifter lowers the dumbbell onto the support at the end of a set of exercise repetitions. Likewise, inboard receivers 110 have centering wedges 112 and 116 to guide the inward facing end of the dumbbell onto platform 114.

Receivers 100, 110 are separated from one another along bar 5 to allow a weightlifter's hand to fit between the receivers to grasp the handle of a dumbbell while it rests on platforms 104, 114. According to one embodiment, the separation between receivers 100 and 110 is about 8 inches.

Left and right dumbbell supports 101R, 101L are positioned along bar 5 at locations so that, when support 1 is engaged with a rack 20, and dumbbells 30 are positioned on the supports, the dumbbells are located a selected distance apart to allow a selected weight lifting exercise to be performed. According to one embodiment, supports 101R, 101L are positioned so that handles of dumbbells 30 are about a shoulder-width apart for a typical weightlifter, that is, about 30 inches.

Hook engaging portions 4 are designed to engage with j-hooks 28 of a rack 24 in the same manner as an Olympic bar. That is, portions 4 have a diameter of between about 25 mm and 50 mm. According to a preferred embodiment, they have a diameter equal to the grip section of a standard Olympic bar, about 28 mm (1.1 inches). The dimensions of bar 5 and portions 4 are selected to span the distance between j-hooks of commercially available weight-lifting racks, that is, about 40 inches. According to a further embodiment, hook-engaging portions 4 are adapted to engage with other weight supporting structures, such as, barbell rests 28' shown in FIG. 1.

Stop rings 7 are located between hook engaging portions 4 and end pieces 6. When support 1 is installed on rack 20, stop rings 7 are positioned on the outboard side of the j-hooks 28. Stop rings 7 limit the motion of support 1 in the horizontal direction when the support 1 is engaged with the j-hooks to ensure that the support 1 remains centrally positioned between the stanchions 24 of rack 20 and will not accidentally disengage from j-hooks 28.

As shown in FIG. 2*a*, arm 8 is connected with one of the end pieces 6 and extends perpendicularly to axis 9. According to one embodiment, arm 8 is located opposite of stop 7 from j-hook engaging portion 4. According to one embodiment, arm 8 is fixedly connected with end piece 6, for example, by welding.

Figure 7A:
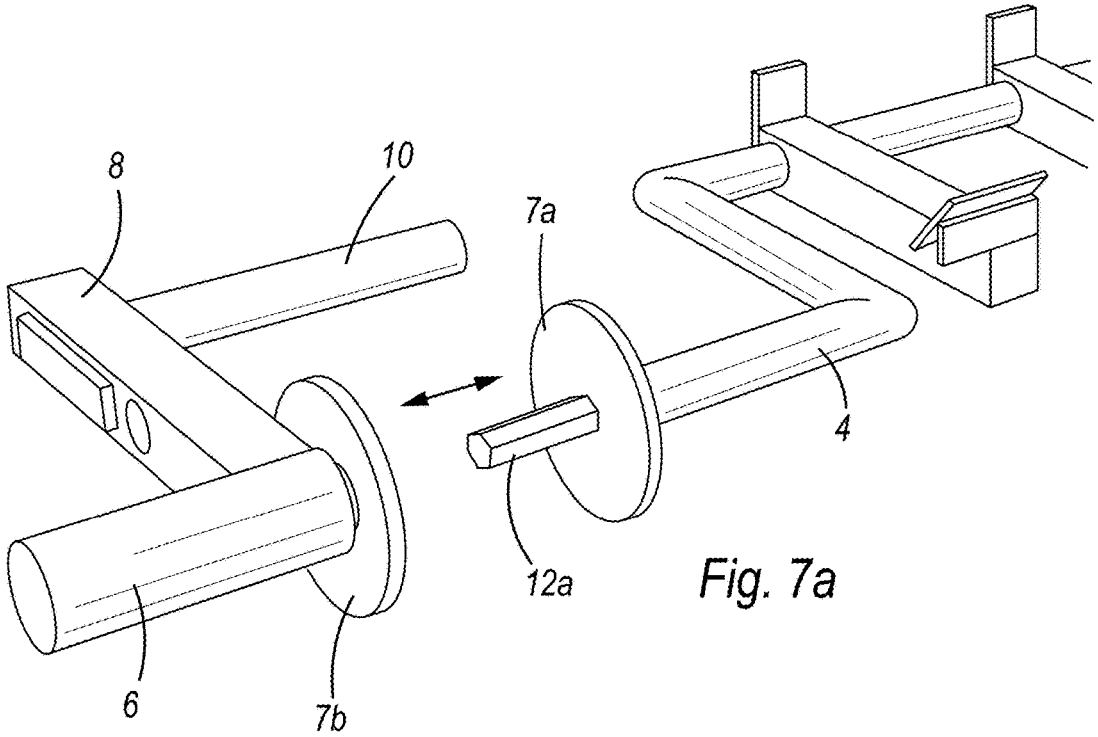
FIGS. 7*a* and 7*b* are perspective views of a fitness weight support according to another embodiment of the disclosure.
Figure 7B:
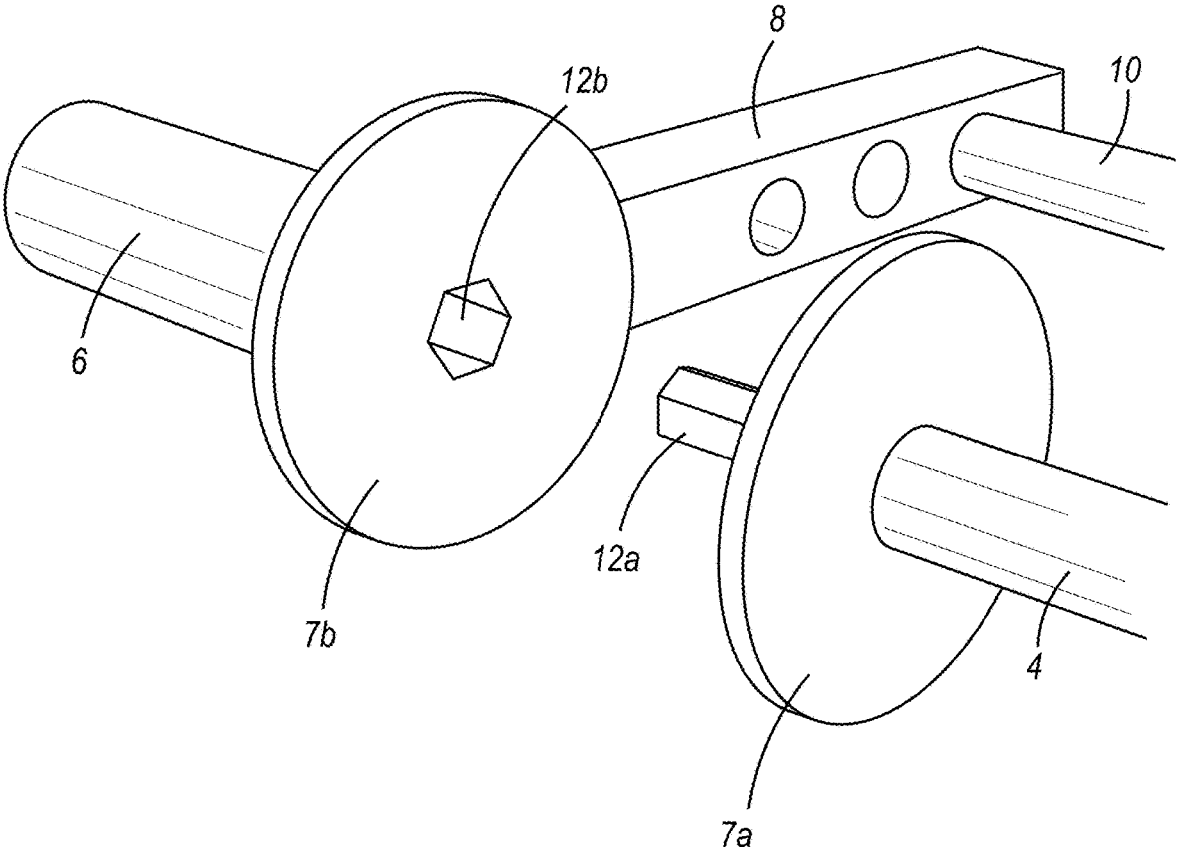

According to another embodiment, shown in FIGS. 7*a* and 7*b*, engaging portion 4 is connected with shaft 12*a* that extends along the axis of engaging portion 4. Plate 7*a* is positioned around shaft 12*a*. Shaft 12*a* has a polygonal shaped cross section, e.g., square, hexagonal, and the like. End piece 6 is fixed to arm 8. Plate 12*b* is fixed to end piece 6 and arm 8. As shown in FIG. 7*b*, plate 7*b*, as well as arm 8 and at least a portion of end piece 6 include an opening 12*b* shaped to fit removably onto shaft 12*a* by sliding the shaft into the hole as shown by the arrows in FIG. 7*a*. When shaft 12*a* is fitted into hole 12*b*, engagement between the polygonal shaped shaft and hole fix the angular position of arm 8 with respect to support 1. Plates 7*a* and 7*b* meet flush with one another to form a stop ring, as discussed above. A locking mechanism, for example, a set screw, a spring driven catch, and the like (not shown) may be provided to removably secure shaft 12*a* into hole 12*b* and prevent the arm from inadvertently disengaging while the support is in use. According to this embodiment, arm 8 is removable from support 1 by sliding plate 7*b* away from plate 7*a* so that arm 8 and end piece 6 slide off of shaft 12*a*, as shown by the arrows in FIG. 7*a*. Allowing end piece 6 and arm 8 to be removed from support 1 may make the support more convenient to store when not in use. In addition, the matching cross sectional shapes of shaft 12*a* and hole 12*b* may be selected to allow arm 8 to be positioned at a variety of angular orientations with respect to the support and may allow support 1 to be configured to fit on a wider variety of commercially available racks.

As shown in the embodiment in FIGS. 2*a* and 2*b*, arm 8 has a plurality of holes 11*a*, 11*b*, 11*c*. Jam pin 10 is removably positioned in one of the holes and extends in the inboard direction parallel to axis 9. The particular hole 11*a*, 11*b*, or 11*c* where pin 10 is engaged is selected to adjust the configuration of support 1 depending on the dimensions of the stanchions 24 of rack 20.

As shown in FIG. 2*a*, support 1 is installed on rack 20 by resting portions 4 onto j-hooks 28. Because offset sections 3 extend toward the back side of the rack, the center of gravity of support 1 is located rearward of the j-hooks 28. This causes bar 5 of support 1 to tend to rotate downward. Jam pin 10 is installed in a selected one of the holes 11*a*, 11*b*, 11*c* so that, when pin 10 contacts vertical stanchion 24, dumbbell supports 101R and 101L are held horizontal. The selected hole 11*a*, 11*b*, 11*c* may vary depending on the dimensions of the stanchion 24 and j-hook 28. By providing a variety of positions for pin 10 along arm 8, support 1 can be adjusted to work with a variety of commercially available racks. Because portions 4 have a diameter that is the same as a typical barbell grip section, support 1 will fit onto commercially available power racks and other fitness equipment designed to support barbells.

Figure 3:
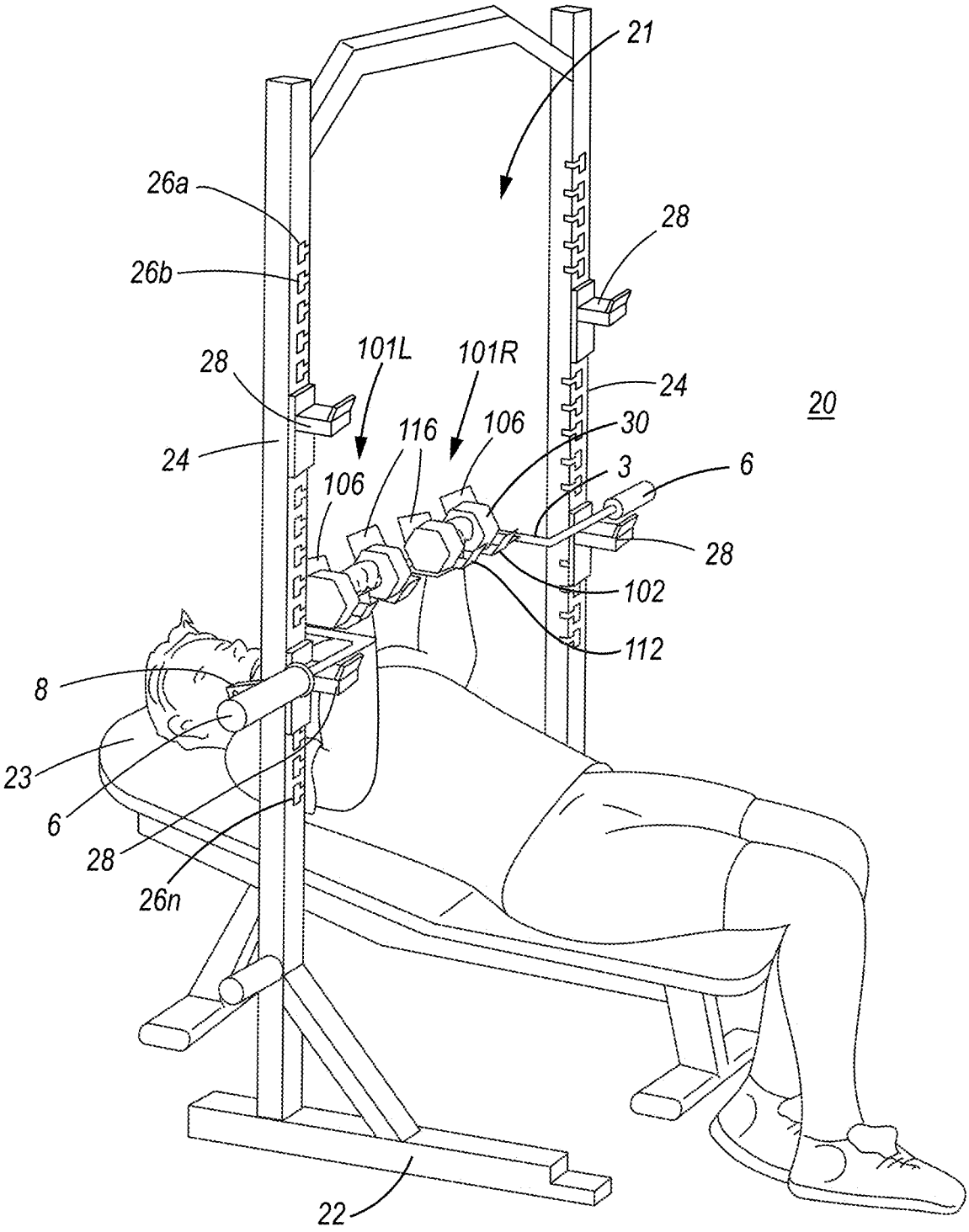
FIG. 3 is a side view of a weightlifter using a support according to an embodiment of the disclosure during a weightlifting exercise.

FIG. 3 is a perspective view of dumbbells supported by support 1 in a position for a weightlifter to perform a dumbbell press. Before the lifter begins the exercise, j-hooks 28 are connected with stanchions 24 at a selected height. Portions 4 of support 1 are positioned onto the j-hooks 28 and jam pin 10 is installed in selected hole 11*a*, 11*b*, or 11*c* so that it contacts stanchion 24 and holds supports 101L, 101R horizontal. Dumbbells 30 are loaded onto supports 101R, 101L. Because the weightlifter can use both arms to load dumbbells onto support 1, heavier dumbbells can be used for the exercise than if the lifter had to raise the dumbbells into a starting position with each hand. The lifter reaches through the space between receivers 100, 110 of right and left dumbbell supports 101R, 101L to grasp the handles of each dumbbell. The weightlifter raises the dumbbells to take them off the supports and lowers and raises the dumbbells to perform one or more repetitions of the exercise. At the end of the final repetition, the weightlifter positions the dumbbells over supports 101R, 101L and lowers them onto the supports. Centering wedges 102, 106, 112, 116 guide the ends of the dumbbells onto platforms 104, 114.

Figure 4A:
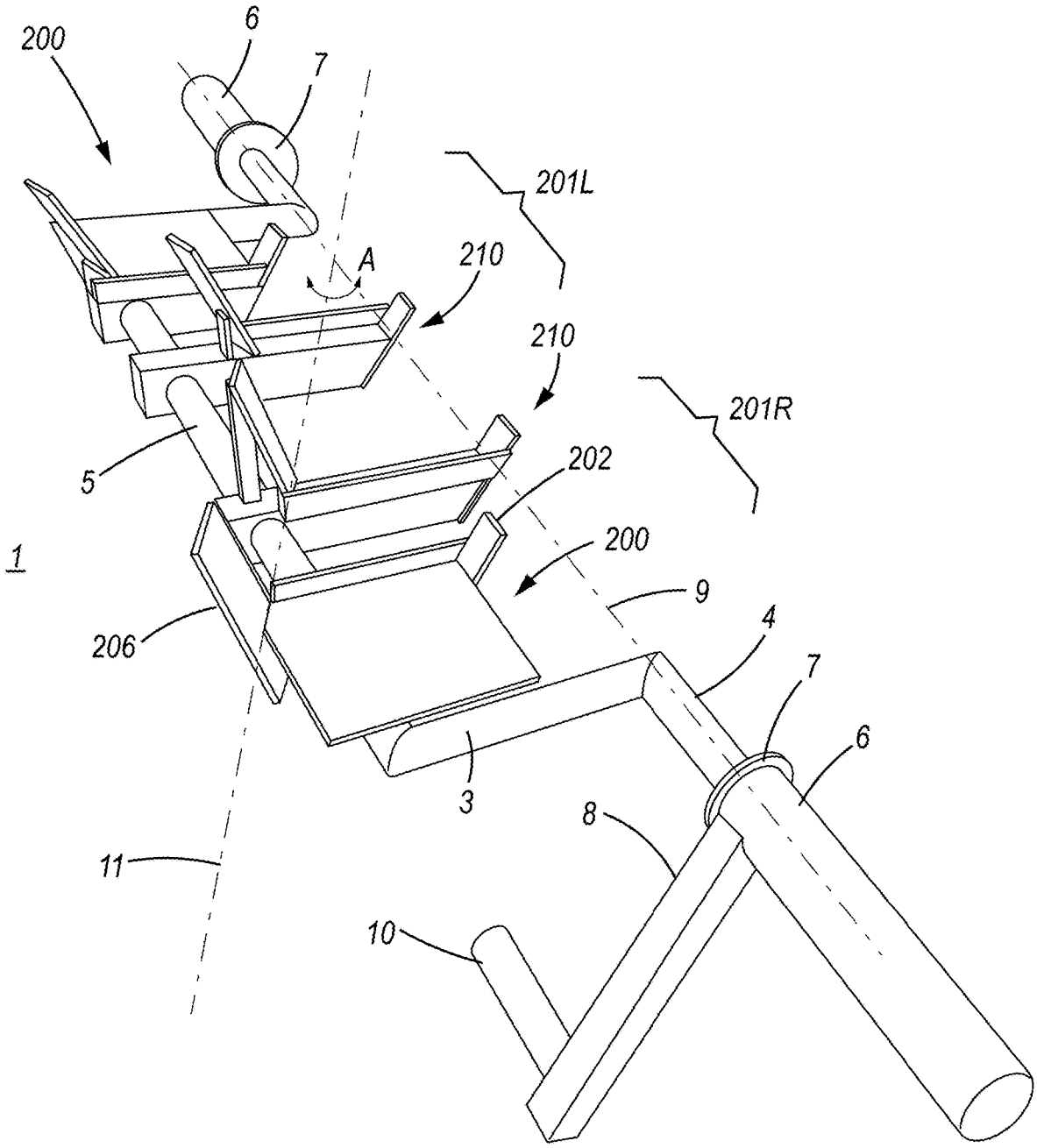
FIG. 4*a* is a perspective view of a fitness weight support according to a further embodiment of the disclosure.
Figure 4B:
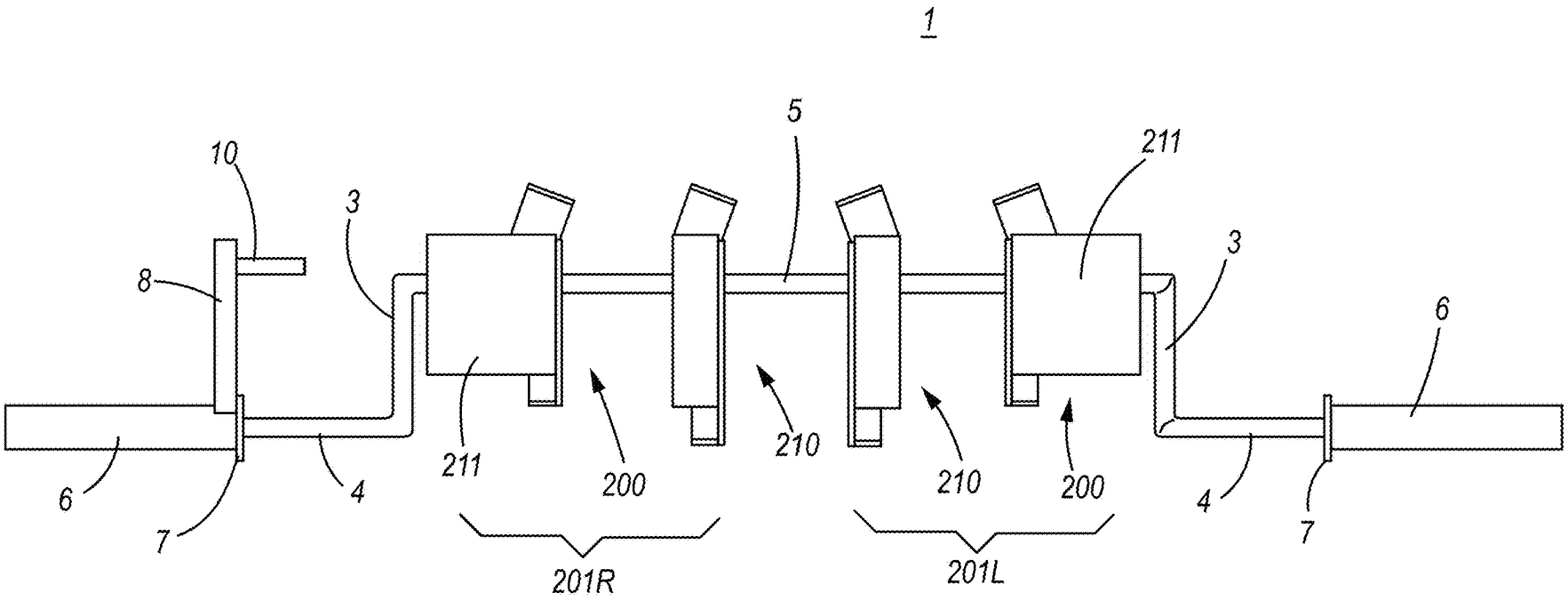
FIG. 4*b* is a top view of the fitness weight support of FIG. 4*a;*

FIGS. 4*a* and 4*b* show a support 1 according to another embodiment of the disclosure. As with the embodiments described above, end pieces 6 connect with j-hook engaging portions 4 on either end of the support 1 along longitudinal axis 9. Extending between portions 4 are offsets 3 and a weight supporting bar 5. Portions 4 engage with j-hooks 28 on vertical supports 24 of rack 20, as described above. Arm 8 and jam pin 10 hold the support is a position where dumbbell supports 201R and 201L are held horizontally.

Figure 5:
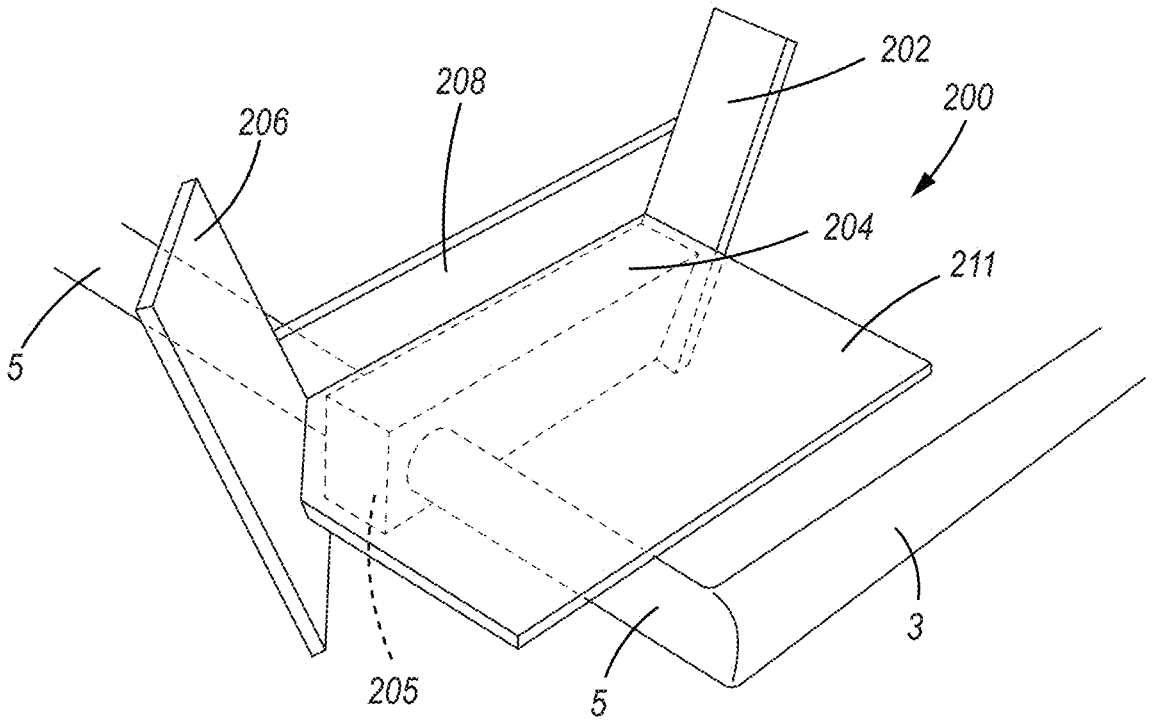
FIG. 5 is a perspective view of a portion of the support of FIG. 4*a* showing an outboard portion of a weight supporting platform.

FIG. 5 is perspective view of outboard receiver 200 according to this embodiment. Horizontal platform 204 is formed along the top surface of support beam 205. Support beam 205 is connected with bar 5, for example, by a weld. Platform extension 211 extends from the edge of beam 205 to provide a widened platform to receive one side of dumbbell 30 when it rests on the support. When the support 1 is installed on a rack, platform 204 and extension 211 are held horizontally.

Front centering wedge 202 is located at the front edge of platform 204. According to one embodiment, front centering wedge 202 is in a plane parallel to the axis 9 of support 1 and is at an oblique angle with respect to the horizontal surface of platform 204. At the rear edge of platform 204 is rear wedge 206. According to one embodiment, rear wedge 206 is at an oblique angle with respect to the horizontal surface of platform 204. Wedges 202 and 206 serve to direct dumbbell 30 into a stable position with respect to receiver 200.

Along one edge of platform 204 is rail 208. Rail 208 extends vertically from the surface of platform 204. When dumbbell 30 is positioned on support 1, rail 208 is positioned inboard of one end of the dumbbell to prevent the dumbbell from moving off platform 204 in the inboard direction. Left and right outboard receivers 200 are mirror images of one another. When each is disposed on bar 5, extensions 211 extend in the outboard direction, that is, away from the center of bar 5 and toward the respective end pieces 6. Rail 208 is located on the inboard side of the receivers 210, that is, toward the center of bar 5.

Figure 6A:
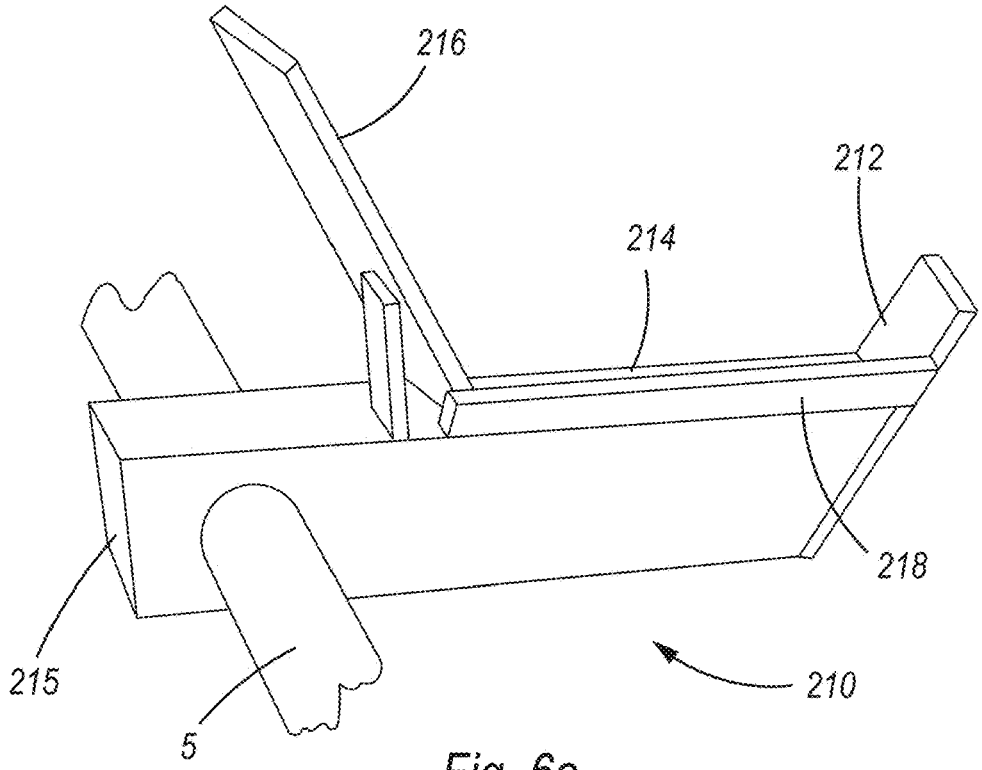
FIGS. 6*a* and 6*b* are perspective views of a portion of the support of FIG. 4*a* showing detailed views of an inboard portion of a weight supporting platform.
Figure 6B:
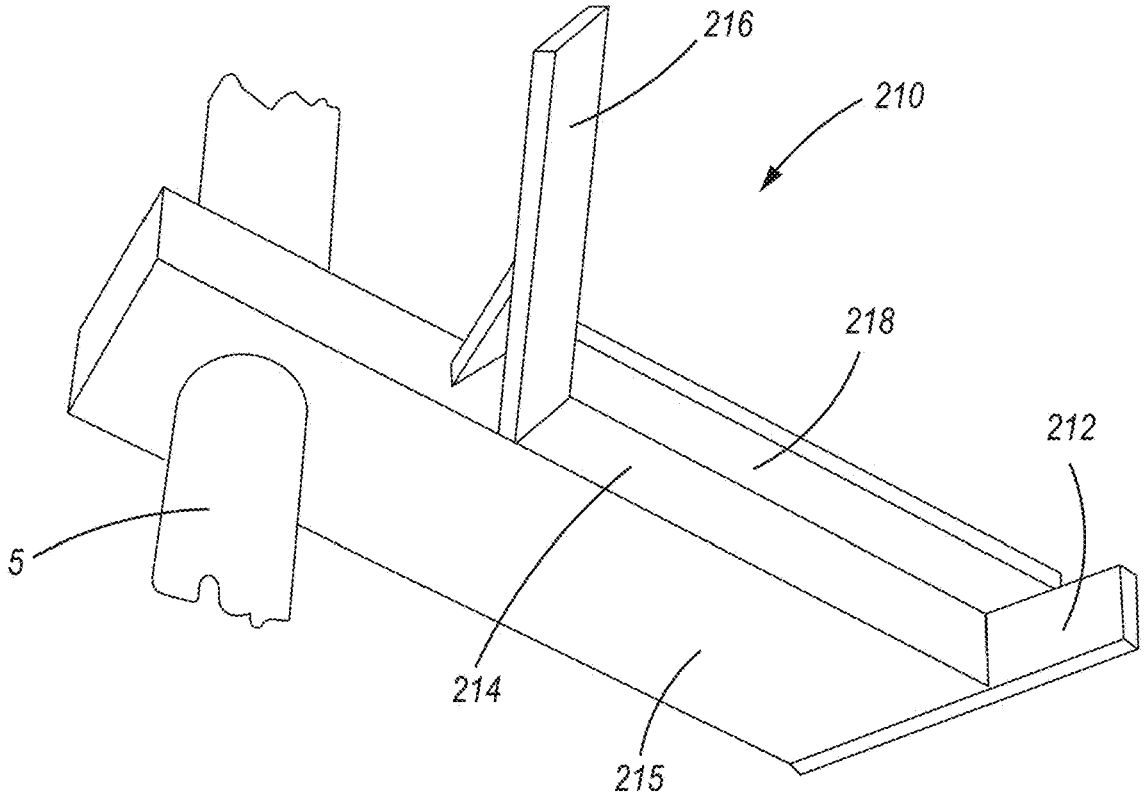

FIGS. 6*a* and 6*b* show perspective views of inboard receivers 210. Platform 214 is formed along the top surface of beam 215. Beam 215 is connected with bar 5, for example, by welding. Front wedge 212 is located at the front edge of beam 215. According to one embodiment, front wedge 212 is at an oblique angle to platform 214 and is in a plane substantially parallel with axis 9. Rear wedge 216 is positioned toward the rear of bar 215 and is at an oblique angle with respect to platform 214. Rail 218 is located long the outboard edge of platform 214 to prevent dumbbell from moving off of platform 214 in the outboard direction. Inboard receivers 210 are arranged on bar 5 with rail 218 positioned on the outboard side of the receiver 210. Inboard receivers 210 forming parts of left and right supports 201L, 201R are mirror images of each other.

According to a further embodiment as shown in 4*a*, rear wedge 206 of outboard receiver 200 and rear wedge 216 of inboard receiver 210 are an oblique angle with respect to axis 9 and are coplanar with one another. Line 11, lying along the surfaces of the rear wedges, is at an angle A with respect to axis 9. In addition, front wedges 202, 212 of the inboard and outboard receivers are offset with respect to one another so that they lie along a line parallel with line 11. According to this embodiment, the configurations of the receivers are selected to cause the handles of dumbbells supported on support 1 to be substantially parallel to line 11 at angle A with respect to axis 9 of support 1. According to one embodiment angle A is between about 20 degrees and about 60 degrees. According to a more preferred embodiment, angle A is about 40 degrees. The angle may be selected so that when the lifter rotates his or her wrists while raising dumbbells during particular exercises, for example, a dumbbell press, at the top of the lift, the dumbbells will be at angle A with respect to support 1 and will smoothly engage with the receivers at the end of a set of exercises.

According to other embodiments of the disclosure, receivers 201L, 201R are configured to receive and support other types of fitness weights than dumbbells. For example, the receivers may be configured to support kettle bells, sandbags, or other types of free weights.

While illustrative embodiments of the disclosure have been described and illustrated above, it should be understood that these are exemplary of the disclosure and are not to be considered as limiting. Additions, deletions, substitutions, and other modifications can be made without departing from the spirit or scope of the disclosure. Accordingly, the disclosure is not to be considered as limited by the foregoing description.

I claim:

1. A removeable fitness weight support for a weightlifting rack comprising:

a platform adapted to support a fitness weight;

two engaging bars, the engaging bars extending outward from the platform, wherein the engaging bars are adapted to removably and rotatably engage with corresponding support fixtures of the rack;

a support member connected with the platform and extending between the engaging bars, wherein the platform is supported by the support member; and a rotation stop extending from at least one of the engaging bars, wherein when the bar is engaged with the corresponding support fixture the rotation stop contacts a vertical stanchion of the rack to prevent rotation of the at least one engaging bar and to hold the platform substantially horizontal.

2. The removeable fitness weight support of claim 1, wherein the platform comprises a bottom panel and one or more guiding wedges, wherein, when the fitness weight is lowered onto the platform, the guiding wedges guide the fitness weight onto the bottom panel.

3. The removeable fitness weight support of claim 2, wherein, when the engaging bars are engaged with the corresponding support fixtures and the rotation stop is in contact with the stanchion of the rack, the bottom panel is horizontal and the guiding wedge is at an oblique angle with respect to the bottom panel.

4. The removeable fitness weight support of claim 1, wherein the platform comprises two fitness weight receiving portions, each receiving portion adapted to stably support the fitness weight.

5. A removeable fitness weight support for a weightlifting rack comprising:

a platform adapted to support a fitness weight;

two engaging bars, the engaging bars extending outward from platform, wherein the engaging bars are adapted to removably engage with corresponding support fixtures of the rack;

a support member connected with the platform and extending between the engaging bars, wherein the platform is supported by the support member; and a rotation stop extending from at least one of the engaging bars, wherein when the engaging bar is engaged with the corresponding support fixture the rotation stop contacts a vertical stanchion of the rack to prevent rotation of the bar and to hold the platform substantially horizontal, wherein the rotation stop comprises:

an arm connected to one of the engaging bars and extending perpendicular to a longitudinal axis of the engaging bar; and a jam pin extending from the arm parallel with the longitudinal axis a selected distance along the arm from the engaging bar, wherein, when the engaging bar is engaged with the support fixture, the jam pin contacts the stanchion of the rack to prevent rotation of the engaging bar.

6. The removeable fitness weight support of claim 5, wherein the arm comprises an engagement portion, wherein the engagement portion removably connects the arm with the engaging bar.

7. The removeable fitness weight support of claim 6, wherein the engaging bar comprises a polygonal shaped portion and the engagement portion comprises a polygonal hole, the polygonal hole adapted to fit onto the polygonal portion.

8. The removeable fitness weight support of claim 5, further comprising two offsets, the offsets connecting the engaging bars with the support member, wherein a center of mass of the platform is offset from the longitudinal axis, wherein the offset center of mass tends to rotate the support in a first direction and wherein the stanchion of the rack engages the jam pin in a direction opposite the first direction.

9. The removeable fitness weight support of claim 5, wherein the arm comprises a plurality of jam pin receiving portions and wherein the jam pin is removably engaged with a selected one of the jam pin receiving portions, the selected jam pin receiving portion being selected to adjust an angle of the platform when the engaging bars are engaged with the corresponding support fixtures and the jam pin is engaged with the stanchion of the rack.

10. A fitness weight support comprising:

a fitness weight supporting platform;

two engaging portions connected with and supporting the platform, wherein the engaging portions extend outward from opposite sides of the platform and are aligned along a longitudinal axis;

two offset arms connected with respective ones of the engaging portions and extending perpendicular to the longitudinal axis;

a platform supporting bar extending parallel with the longitudinal axis and connecting the offset arms to one another, wherein the offset arms and support bar support the weight receiving portions an offset distance from the longitudinal axis; and a rotation stop fixed to at least one of the engaging portions and adapted to hold the platform in a horizontal orientation to receive one or more fitness weights.

11. The fitness weight support of claim 10, wherein the fitness weight supporting platform further comprises an inboard receiver and an outboard receiver, wherein the inboard and outboard receivers are separated by a distance sufficient for a user to extend a hand between the inboard and outboard receivers and grasp a handle of the fitness weight disposed on the inboard and outboard receivers.

12. The fitness weight support of claim 11, wherein the inboard receiver comprises a sloped inboard front panel and a sloped inboard rear panel, wherein the outboard receiver comprises a sloped outboard front panel offset a first distance from the sloped inboard front panel and a sloped outboard rear panel offset a second distance from the sloped inboard rear panel, and wherein the first and second distances are selected to orient a fitness weight supported by the platform a first angle with respect to the longitudinal axis.

13. The fitness weight support of claim 12, wherein the first angle is between about 20 degrees and about 60 degrees.

14. The fitness weight support of claim 13, wherein the first angle is about 40 degrees.

15. The fitness weight support of claim 11, wherein the inboard receiver comprises an inboard horizontal support surface and an inboard rail, the inboard rail extending along an outboard edge of the inboard receiver and vertically from the inboard support surface, wherein a first end of the fitness weight resting on the inboard support surface is prevented from moving in the outboard direction by the inboard rail.

16. The fitness weight support of claim 11, wherein the outboard receiver comprises an outboard horizontal support surface and an outboard rail, the outboard rail extending along an inboard edge of the outboard receiver and vertically from the outboard support surface, wherein a second end of the fitness weight resting on the outboard support surface is prevented from moving in the inboard direction by the outboard rail.

17. The fitness weight support of claim 10, wherein the platform comprises two fitness weight receiving portions, each adapted to hold a respective fitness weight.

18. The fitness weight support of claim 10, wherein the rotation stop comprises an arm extending perpendicular to the longitudinal axis and a jam pin connected with the arm and extending parallel to the longitudinal axis in the inboard direction, wherein the jam pin is adapted to engage with a vertical stanchion of a rack to prevent the engaging portion from rotating in at least one direction.

19. The fitness weight support of claim 10, wherein the fitness weight supporting platform comprises a sloped front panel, a sloped rear panel, and a horizontal support surface, wherein the fitness weight is received along upper surfaces of the front and rear panels and rests on the support surface.

* * * * *